US009926519B2

(12) United States Patent
Rees et al.

(10) Patent No.: US 9,926,519 B2
(45) Date of Patent: Mar. 27, 2018

(54) SELF-ADHESIVE DETERGENT COMPOSITIONS WITH COLOR-CHANGING SYSTEMS

(75) Inventors: Wayne M. Rees, Racine, WI (US); Thomas A. Strash, Kenosha, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 630 days.

(21) Appl. No.: 13/491,980

(22) Filed: Jun. 8, 2012

(65) Prior Publication Data

US 2013/0331308 A1 Dec. 12, 2013

(51) Int. Cl.

*C11D 11/00* (2006.01)
*C11D 3/40* (2006.01)
*C11D 17/00* (2006.01)

(52) U.S. Cl.

CPC ..... *C11D 3/40* (2013.01); *C11D 17/003* (2013.01)

(58) Field of Classification Search

CPC ..... C11D 3/361
USPC ..... 510/469, 490, 493, 494, 499
See application file for complete search history.

(56) References Cited

U.S. PATENT DOCUMENTS

| | | | | |
|---|---|---|---|---|
| 4,209,864 | A | 7/1980 | Lindauer | |
| 4,597,941 | A * | 7/1986 | Bottom et al. | 422/37 |
| 4,666,671 | A * | 5/1987 | Purzycki et al. | 422/5 |
| 4,962,021 | A | 10/1990 | Meserol et al. | |
| 5,009,887 | A | 4/1991 | Iwahashi | |
| 5,809,590 | A | 9/1998 | Williams et al. | |
| 6,336,977 | B1 | 1/2002 | Menke et al. | |
| 6,419,902 | B1 | 7/2002 | Wright | |
| 6,648,650 | B1 | 11/2003 | Fiorella | |
| 6,667,286 | B1 | 12/2003 | Dettinger et al. | |
| 6,683,035 | B1 * | 1/2004 | Koester et al. | 510/191 |
| 6,811,403 | B1 | 11/2004 | Camarena | |
| 7,442,725 | B2 * | 10/2008 | Kwan et al. | 523/161 |
| 7,621,462 | B2 | 11/2009 | Faires | |
| 2006/0222601 | A1 | 10/2006 | Sabnis et al. | |
| 2006/0222675 | A1 * | 10/2006 | Sabnis et al. | 424/405 |
| 2006/0230576 | A1 | 10/2006 | Meine | |
| 2006/0236470 | A1 | 10/2006 | Sabnis et al. | |
| 2006/0257439 | A1 * | 11/2006 | Sabnis et al. | 424/401 |
| 2006/0262828 | A1 | 11/2006 | Ambrozy et al. | |
| 2006/0293205 | A1 | 12/2006 | Chung | |
| 2007/0010400 | A1 * | 1/2007 | Sabnis et al. | 504/116.1 |
| 2008/0103082 | A1 | 5/2008 | Palmer | |
| 2008/0190457 | A1 * | 8/2008 | Veltman et al. | 134/22.19 |
| 2008/0223413 | A1 * | 9/2008 | Radford | 134/34 |
| 2008/0242570 | A1 * | 10/2008 | Carter et al. | 510/100 |
| 2008/0255017 | A1 * | 10/2008 | Dettinger et al. | 510/191 |
| 2008/0295761 | A1 | 12/2008 | Ambrozy et al. | |
| 2009/0215661 | A1 * | 8/2009 | Klinkhammer et al. | 510/192 |
| 2010/0093586 | A1 * | 4/2010 | Klinkhammer et al. | 510/193 |
| 2010/0120648 | A1 * | 5/2010 | Veltman et al. | 510/193 |
| 2010/0130399 | A1 | 5/2010 | Abbas et al. | |
| 2010/0266794 | A1 | 10/2010 | Wright et al. | |

FOREIGN PATENT DOCUMENTS

| | | | |
|---|---|---|---|
| DE | 10238431 | A1 | 3/2004 |
| DE | 102008059509 | A1 | 6/2010 |
| EP | 0255978 | A2 | 2/1988 |
| EP | 0960932 | A1 | 12/1999 |
| EP | 0 488 980 | B1 | 7/2001 |
| JP | 2000-226600 | A | 8/2000 |
| JP | 2000-273497 | A | 10/2000 |
| WO | 2008117233 | A1 | 10/2008 |
| WO | 2008117235 | A1 | 10/2008 |
| WO | 2009027925 | A2 | 3/2009 |

OTHER PUBLICATIONS

International Search and Written Opinion dated Aug. 30, 2013 for International Application No. PCT/US2013/044490, International Filing Date Jun. 6, 2013.

* cited by examiner

*Primary Examiner* — Nicole M Buie-Hatcher
*Assistant Examiner* — M. Reza Asdjodi

(57) ABSTRACT

Self-adhesive detergent compositions are described including a pH-sensitive color-changing system. The color-changing system is useful with certain acidic compositions and certain alkaline compositions. The compositions have a given color upon application to a hard surface, e.g., a toilet bowl. In one embodiment, when the self-adhesive composition is exposed to a water-based rinse, such as on flushing a toilet, the color-changing system provides the released cleaning portion of the composition, and thereby the water, with a color different from the color of the composition to indicate cleaning is occurring. In another embodiment, following exposure to a plurality of rinses, the color-changing system changes the color of the composition when the composition is near depletion to provide an "end-of-use" cue. In another embodiment, the color-changing system indicates dual functions by changing the color of the composition to another color when the composition is physically mixed with a rinse to provide manual cleaning.

33 Claims, No Drawings

SELF-ADHESIVE DETERGENT COMPOSITIONS WITH COLOR-CHANGING SYSTEMS

FIELD OF INVENTION

Self-adhesive detergent compositions for hard surface cleaning applications are described having pH-sensitive color-changing systems. The detergent compositions provide for repeated releases of cleaning portions of the detergent composition upon a plurality of separate water-based rinses. A first embodiment of the color-changing system involves providing a detergent composition with an acidic or alkaline color-changing system providing the composition with a first color and a cleaning portion of the composition dissolved into the water-based rinse with a second color when the water-based rinse flows over the composition. The second color of the color-changing system indicates to a user that the detergent composition is "working", i.e., cleaning. A second embodiment of the color-changing system provides a detergent composition with an acidic or alkaline color changing system providing the composition with a first color. When a predetermined amount of cleaning portions have been released through numerous water-based rinses of the composition, the composition turns a second color to serve as an end-of-life cue so a user will know it is time or almost time to insert a new self-adhering detergent composition. A third embodiment of the color-changing system provides a detergent composition with an acidic or alkaline color changing system which indicates to a user a dual purpose of the detergent composition, i.e., automatic/continuing cleaning upon a water-based rinse or single manual cleaning. When applied to a surface, the detergent composition has a first color. This first color of the composition is maintained through numerous water-based rinses where automatic/continuous cleaning is provided with each rinse. During the use life of the composition, a user may desire to use the remaining portion of the composition for a manual cleaning of the surface to which it has been applied. This remaining portion upon physical mixing with rinse water for a manual cleaning (e.g., by scrubbing or wiping with a brush, sponge or cloth cleaning implement) will change to a second color distinct from the first color. This color change indicates to the user the dual functioning of the single composition, i.e., that the automatic/continuous cleaning composition has now become a manual cleaner.

BACKGROUND OF THE INVENTION

Consumer cleaning products incorporating a color change feature are desirable to an end user. The color change may indicate that the product is effectively working. A color change may also indicate that the product has reached the end of its effective in-use lifetime. Color changes may connote other meaningful signals to the user, such as providing a synergistic aesthetic visual signal in tandem with the reduction of product fragrance intensity.

Self-adhering gel compositions are known for use as continuous hard surface cleaning systems, such as for flush toilets, wherein water passes over the gel composition with each flush of the toilet, thereby eroding or dissolving a minor amount of the composition with each flush and distributing cleaning ingredients to the toilet water and toilet bowl surface above and/or below the water line depending on the composition. Self-adhering gel compositions are described in U.S. Pat. No. 6,667,286 B1 and U.S. Patent Application Publication Nos. 2008/0255017 A1 and 2009/0215661 A1, the disclosures of this patent and each of these applications being incorporated herein by reference.

U.S. Pat. No. 6,667,286 B1 and U.S. Patent Application Publication No. 2008/0255017 A1 disclose the incorporation of a dye or colorant into the gel compositions. However, no information is provided as to the selection of any specific dye or colorant. Further, no color-changing system of any type is disclosed. The self-adhering gel compositions disclosed are used as continuous hard surface cleaning systems where, in use, water periodically passes over the gel composition. The compositions are especially applicable as self-adhesive, continuous, self-cleaning sanitary compositions for use in flush toilets and urinals.

SUMMARY OF INVENTION

In a first embodiment, a self-adhering detergent composition includes sufficient color-changing tinting agent(s) so as to provide both a specific color to the adhered composition, which is preferably in gel form, and a second distinct color to a released cleaning portion of the composition and thereby to the water-based rinse, so as to connote a visible color-change cue indicating that the product is "working", i.e., cleaning, such as when in flushed toilet bowl water. In this embodiment, the self-adhering gel compositions contain a pH control system and a somewhat elevated level of color-changing dye(s), such that upon application to a hard surface, such as a toilet bowl, the gel is one color, and when water is flushed over the gel, enough dye is dispersed in a released or dissolved cleaning portion from the gel so as to turn the flushed water a second color, distinct from the original or first color of the applied gel.

In a second embodiment, the self-adhering detergent compositions, preferably in gel form, are provided with a first color when newly applied to a hard surface, and a second color, which is distinct from the first color, to the adhered gel composition as the composition nears the end of its useful lifetime, thus providing a color-change use-up indicator. In this second embodiment, the gel compositions contain a pH control system and a lower level of color-changing dye(s), such that upon initial application to a hard surface, such as a toilet bowl, the composition is one distinct color, and following numerous toilet flushings involving contact of the flush water flowing over the gel composition, the color of the gel composition gradually changes to a second color which is distinct from the first color.

In a third embodiment, the self-adhering detergent composition, preferably in gel form, is provided with a first color when newly applied to a hard surface to be treated. The applied gel composition during adherence to the hard surface maintains this first color through numerous rinsings/flushings with tap water. At a time of a user's choosing, the remaining portion of the adhered composition can be physical mixed all at once with a substantial amount of tap water (e.g., about a liter) to be used as a manual cleaner, such as by scrubbing or wiping with a brush, sponge, cloth, or other cleaning implement. Upon mixing the remaining portion of the composition with such water, a second color, which is distinct from the first color, is provided in the composition. The different colors indicate the dual purpose/function of the composition, i.e., the first color to indicate automatic/continuous cleaning with each of a plurality of separate water rinses and a second color to indicate conversion and use as a manual cleaner.

Self-adhering gel compositions are known for use as continuous cleaning systems for hard surfaces where the adhered gels are regularly rinsed with tap water. Examples of suitable hard surfaces for cleaning with the self-adhesive composition include flush toilets and urinals, wherein the gel is applied to the interior surface of the toilet bowl or on an interior urinal wall above the water line. Tap water passes over the gel composition with each flush of the toilet/urinal, thereby eroding or dissolving a minor amount of the composition with each flush and distributing cleaning ingredients to the toilet bowl/urinal water and toilet bowl/urinal surface above and below the water line. Self-adhering gel compositions are described in U.S. Pat. No. 6,667,286 B1 and U.S. Patent Application Publication Nos. 2008/0255017 A1 and 2009/0215661 A1, which are all incorporated herein by reference. The inventive detergent gel composition embodiments described herein are formulated with either an acidic pH control system in a pH range of about 2 to about 5, or a alkaline pH control system in a range of about 9 to about 12. The inventive acidic gels contain one or more color-changing dye which undergoes a color change in a pH range of about 3 to about 6. The inventive alkaline gels contain one or more color-changing dye which undergoes a color change in a pH range of about 9 to about 11.

DETAILED DESCRIPTION OF THE INVENTION

As used herein, "composition" refers to any solid, gel and/or paste substance having more than one component.

As used herein, "self-adhesive" or "self-adhering" refers to the ability of a composition to stick onto a hard surface without the need for a separate adhesive or other support device. In one embodiment, a self-adhesive composition does not leave any residue or other substance (i.e., additional adhesive) once the composition is used up.

As used herein, "gel" refers to a disordered solid composed of a liquid with a network of interacting particles or polymers which has a non-zero yield stress.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of actual active ingredient in the total formula of component or composition. For example, an off-the-shelf composition of Formula X may only contain 70% active ingredient X. Thus, 10 g. of the off-the-shelf composition only contains 7 g. of X. If 10 g. of the off-the-shelf composition is added to 90 g. of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. Non-limiting examples of ceramic surfaces include: toilet bowl, sink, shower, tile, the like, and combinations thereof. A non-limiting example of glass surfaces include: window and the like. Non-limiting examples of metal surfaces include: sink, automobiles, the like, and combinations thereof. Non-limiting examples of a polymeric surface includes: fiberglass, acrylic, Corian®, the like, and combinations thereof. A non-limiting example of a stone hard surface includes: granite, marble, and the like.

A hard surface may be any shape, size, or have any orientation that is suitable for its desired purpose. In one non-limiting example, a hard surface may be a window which may be oriented in a vertical configuration. In another non-limiting example, a hard surface may be the surface of a curved surface, such as a ceramic toilet bowl. It is thought that the shape, size and/or orientation of the hard surface will not affect the compositions of the present invention because of the unexpectedly strong transport properties of the compositions as described in U.S. Patent Application Publication No. 2009/0215661 A1.

As used herein, "surfactant" refers to any agent that lowers the surface tension of a liquid, for example water. Exemplary surfactants which may be suitable for use with the present invention are described infra. In one embodiment, surfactants may be selected from the group consisting of anionic, nonionic, cationic, amphoteric, zwitterionic, and combinations thereof. In other nonlimiting embodiments, the surfactant may be a superwetter. One of skill in the art will appreciate that in some embodiments, a substance which may be used as an adhesion promoter may also be a surfactant.

In use, the composition of the invention may be applied directly on the hard surface to be treated, e.g., cleaned, such as a toilet bowl, shower or bath enclosure, window, or the like, and self-adheres thereto, including through a plurality of flows of water (rinses) passing over the self-adhering composition and surface, e.g., flushes, showers, or the like. Each time water flows over the composition, a minor portion of the composition is released into the water that flows over the composition. Accordingly, the amount of self-adhering composition progressively lessens over the use-life of the composition, i.e., with the dissolution/erosion of a minor portion of the self-adherent composition upon each rinsing with water, the amount of adherent composition is decreased. The portion of the composition released onto the water covered surface provides a continuous wet film to the surface to in turn provide for immediate and long term cleaning and/or disinfecting and/or fragrancing or other surface treatment depending on the active agent(s) present in the composition. It is thought that the composition, and thus the active agents of the composition, may spread out from or are delivered from the initial composition placement in direct contact with the surface to coat continuously an extended area on the surface. The wet film acts as a coating and emanates from the self-adhering composition in all directions, i.e., 360°, from the composition, which includes in a direction against the flow of the rinse water as described in U.S. Patent Application Publication No. 2009/0215661 A1.

It is observed that the non-limiting exemplary compositions of the present invention provide for a rapid and extended self-spreading. Without wishing to be limited by theory, it is thought that the self-spreading effect may be modified through the addition of specific surfactants to the composition. Non-limiting examples of factors which are thought to affect the speed and distance of the self-spreading include: the amount of surfactant present, the type of surfactant present, the combination of surfactants present, the amount of spreading of the surfactant over the water flow, the ability of the surfactant to adsorb at the liquid/air interface, and the surface energy of the treated surface. It is thought that the surfactant of the composition serves to push other molecules, e.g., compounds, around so as to deliver these compounds to other parts of the surface. Compounds desirable for extended delivery over a treated surface are active agents, e.g., agents capable of activity as opposed to being inert or static. Non-limiting examples of active agents, or active ingredients, that may be used include: cleaning compounds, germicides, antimicrobials, bleaches, fragrances, surface modifiers, stain preventers (such as a chelator) the like, and combinations thereof. The composition is especially useful in treating the surface of a toilet bowl since it allows for delivery and retention of a desired active agent on a surface above the water line in the bowl as well as below the water line.

The detergent compositions can be applied directly to a surface using any suitable applicator device, such as a pump or syringe-type device, manual, pressurized, or mechanized, aerosol, or sprayer. The consumer may activate the applicator for application of the composition directly to a surface without the need to touch the surface. In the case of a toilet bowl surface, this provides for a hygienic and easily accessible method of application. The amount and location(s) of the composition may be chosen by the user, e.g. one or more dollops or drops of composition, or one or more lines of composition. The composition self-adheres to a hard surface to which it is applied, such as the ceramic side wall of a toilet bowl or shower wall Preferably, the composition has a gel or gel-like consistency. In the described embodiment, the composition is, thus, firm but not rigid as a solid.

The adhesion obtained by the compositions of the invention allow application on a vertical surface without becoming detached through a plurality of streams of rinse water and the gradual washing away of a minor portion of the composition over time to provide the desired cleaning and/or disinfecting and/or fragrance or other treatment action. Once the composition is completely washed away, nothing remains for removal and more composition is simply applied.

It is well understood that tap water is weakly buffered in the pH range of about 6 to about 8. For example, according to the U.S. Environmental Protection Agency guidelines, drinking water (municipal and well "tap" water) should have a pH in the range of 6.5-8.5 (US EPA National Secondary Drinking Water Regulations: Guidance for Nuisance Chemicals).

The inventive detergent compositions described herein are formulated with either an acidic pH control system wherein the pH is in a range of about 2 to about 5 or an alkaline pH control system wherein the pH is in a range of about 9 to about 12. The inventive acidic detergent compositions contain one or more color-changing dye which undergoes a color change at a pH in a range of about 3 to about 6. The inventive alkaline detergent compositions contain one or more color-changing dye which undergoes a color change at a pH in a range of about 9 to about 11.

Without being bound by theory, it is believed in the acidic gel version of the first embodiment of the invention, that with gel application to a hard surface and rinsing/flushing with tap water, a minor fraction of an inventive acidic gel composition including the color-changing dye(s) and pH control agents are released through dissolution or erosion into the buffered rinse or flush tap water, thus changing the pH environment of the dyes from a pH of less than 6 to a pH of about 6 to about 8 to thereby produce a color shift (change) in the released dye(s). Similarly, in the alkaline gel composition version of the first embodiment of the invention, upon gel application to a hard surface and rinsing/flushing with tap water, a minor fraction of an inventive alkaline gel composition including the color-changing dye(s) and pH control agents are released into the buffered rinse or flush tap water, thus changing the pH environment of the dyes from a pH greater than or equal to 9 to a pH of about 6 to about 8 to thereby produce a color shift (change) in the released dyes. The amount of pH control agents present in the acidic/alkaline gels is high enough to maintain pH stability in the formulated gel through numerous rinsings/flushings, yet low enough so that they are readily overwhelmed by the buffering capacity of the volume of rinsing/flushing tap water. This is facilitated by engineering the gels such that very minor amounts of gel are dissolved/eroded with each flush (i.e., rinsing with water), combined with the use of the lowest effective levels of pH control agent in the gels suitable for the specific embodiment, with less than 5% by weight of pH control agent in the inventive compositions, preferably less than about 1% by weight. In both the acidic and alkaline gel versions of the first embodiment, the concentration of color-changing dye(s) is present in the range of 0.01 to about 2.0% by weight.

Without being bound by theory, it is believed in the acidic gel version of the second embodiment, that upon gel application to a hard surface and rinsing/flushing with tap water, the buffered rinse/flush tap water reacts with a fraction of the pH control agents within the gel itself, thus slowly raising the pH environment of the remaining adhered gel as the number of flushes progresses, hence producing a color shift (change) in the dye(s) in the gel. Similarly, in the alkaline gel version of the second embodiment, with gel application to the hard surface and rinsing/flushing with tap water, the buffered rinse/flush tap water and carbon dioxide in the atmosphere react with a fraction of the pH control agents in the gel, thus slowly lowering the pH environment of the remaining adhered gel as the number of flushes progresses, hence producing a color shift (change) in the dyes in the gel. The amount of pH control agents present in the acidic/alkaline gels is low enough such that they are slowly consumed by the buffering capacity of the rinsing/flushing tap water, over the number of rinses/flushes desired to indicate "use-up". This is facilitated by engineering the gels such that minor amounts of gel are dissolved/eroded with each flush/rinsing combined with the use of the lowest effective levels of pH control agent(s) in the gels suitable for the specific embodiment, with less than about 1% by weight pH control agent(s) in the inventive gels, preferably less than 0.1% by weight. In both the acidic and alkaline gel versions of the second embodiment, the concentration of color-changing dye(s) is present in the range of about 0.0001 to about 0.10% by weight.

Without being bound by theory, it is believed that in the acidic gel version of the third embodiment, the pH control system of the composition must be sufficiently concentrated to prevent a significant pH increase in the applied composition over numerous rinsings/flushings with tap water. Thus, as the applied adhered product is dissolved/eroded over time, the color of the gel does not substantially change. However, in this third embodiment, when a significant fraction (about 50 to about 90%) of the gel has been dissolved/eroded, the remaining fraction of adhered gel is intended to be physically mixed with a sizable amount of tap water (about a liter) as part of a manual cleaning process for the hard surface. Thus, the pH control system of the gel is formulated such that the pH of the combined cleaning gel and water is about 6 or greater, providing a distinctly different color to the combined cleaning gel and water relative to the color of the initially applied gel. Similarly, in the alkaline gel version of the third embodiment, the pH control system of the composition must be sufficiently concentrated to prevent significant pH decrease in the applied gel over numerous rinsings/flushings with tap water. Thus, as the applied adhered product is dissolved/eroded over time, the color of the gel does not substantially change. However, in this third embodiment, when a significant fraction (about 50 to about 90%) of the gel has been dissolved/eroded, the remaining fraction of adhered gel is intended to be physically mixed with a sizable amount of tap water (about a liter) as part of a manual cleaning process for the hard surface. Thus, the pH control system of the gel is formulated such that the pH of the combined cleaning gel and water is about 8 or below, providing a distinctly different color to the combined cleaning gel and water relative to the initially applied gel. Effective levels of pH control agent(s) in the acidic and alkaline gel versions of the third embodiment are in a range of about 0.01 to about 1% by weight. In the acidic and alkaline gel versions of the third embodiment, the concentration of color-changing dye(s) is present in a range of about 0.001 to about 0.5% by weight.

As above described, the amount and type of pH control agent and color-changing dye(s) in the gel must be adjusted to achieve the desired color-changing effect, and will vary with factors such as the amount of gel initially placed on a hard surface to be treated, the amount of water used in each rinse/flush of the surface, and the intended duration (life) of the product in use.

Color-changing dyes suitable for the acidic gel versions experience a visual color change within the pH range of about 3 to about 6. Preferred color-changing dye indicators appropriate for the acidic gel versions of the three embodiments include, without limitation, the compounds methyl yellow, bromophenol blue, methyl orange, bromocresol green, methyl red, and bromocresol purple.

A variety of acidic pH control agents may be used to adjust the pH of the acidic gel compositions. These include, but are not limited to, mineral acids (e.g., HCl, $H_2SO_4$, $H_3PO_4$, and $HNO_3$), alkali metal bisulfate salts, carboxylic acids, organo-sulfonic acids (R—$SO_3H$, where R=an aryl or alkyl group), organo-phosphonic acids (R—$PO_3H_2$, where R=an aryl or alkyl group), and sulfamic acid. Mildly acidic compounds having an acid dissociation constant between about $10^{-2}$ and about $10^{-6}$ are preferred as pH control agents for the acidic gels. Acids alone or buffered combinations of the acids with their conjugate base salts may be employed. The use of carboxylic acids alone or in combination with their conjugate base salts are highly preferred due to their low cost, favorable eco-tox profile, and low corrosivity. Preferred pH control agents for acidic gels include alkali metal bisulfate salts, formic acid, acetic acid, propanoic acid, benzoic acid, phthalic acid, malonic acid, succinic acid, oxalic acid, glycolic acid, lactic acid, gluconic acid, glucoheptanoic acid, malic acid, citric acid, homo- and co-polymers of acrylic acid, homo- and co-polymers of maleic acid, aminocarboxylic acid chelants—EDTA (ethylenediaminetetraacetic acid), NTA (nitrilotriacetic acid), HEDTA (N-(hydroxyethyl)-ethylenediamine triacetic acid), IDA (iminodiacetic acid) and the like, and various amino phosphonic acid chelants—such as those sold under the DEQUEST trade name (Thermphos Corporation, Red Bank, N.J. USA).

Color-changing dyes suitable for the alkaline gel embodiments experience a visual color change in within the pH range of about 9 to about 11. Preferred color changing dye indicators appropriate for the alkaline gel embodiments include, without limitation, the compounds alizarin yellow R, thymolphthalein, phenolphthalein, and thymol blue. A variety of alkaline pH control agents may be used to adjust the pH of the alkaline gel compositions. These include, but are not limited to one or more of the following: alkali metal and alkaline earth hydroxides, alkali metal or alkaline earth oxides, alkali metal salts of carbonate, bicarbonate, phosphate, various borates, silicates, and aluminates, ammonia, ethanol amines, and isopropanol amines, as well as fully neutralized salts of aminocarboxylic acid and aminophosphonic acid chelants.

In the embodiments of the invention including the pH-sensitive color-changing systems, the self-adhesive compositions, in addition to including the color-changing systems described above, includes at least one adhesion promoter which causes a bond with water and gives the composition a dimensional stability even under the action of rinse water; at least one nonionic surfactant (which may serve all or in part as the adhesion promoter), preferably an ethoxylated alcohol. Preferably, the embodiments include one or more surfactants distinct from the adhesion promoter, selected from the group consisting of nonionic, anionic, cationic, zwitterionic, and amphoteric surfactants. The embodiments preferably contain fragrance; mineral oil; water; and at least one solvent. In some embodiments, the composition may also include a superwetter compound to enhance the spreading of the wet film. The composition displays extended durability without the necessity of an exterior hanging device or holder thereby only requiring a new application of the composition to the surface after a long lapse of time and no need to remove any device.

In some non-limiting examples, there are a number of components of the present invention composition that are suitable for treating hard surfaces. In one embodiment, the composition comprises an adhesion promoter present in an amount of from about 20 wt. % to about 80 wt. %. In another embodiment, the composition comprises an adhesion promoter in the amount of from about 20 wt. % to about 60 wt. %. In another embodiment, the composition comprises an adhesion promoter in the amount of from about 20 wt. % to about 40 wt. %. In an alternative embodiment, the composition comprises an adhesion promoter in the amount of from about 25 wt. % to about 35 wt. %.

In another embodiment, the composition comprises at least one surfactant, distinct from the adhesion promoter, in an amount of greater than about 1 wt. %. In another embodiment, the composition comprises at least one surfactant distinct from the adhesion promoter in an amount of from about 2 wt. % to about 10 wt. %. In a preferred embodiment, the surfactant(s) distinct from the adhesion promoter are nonionic surfactants, selected from the group comprising C10-C15 ethoxylated alcohols. Surprisingly, it has been found that for reasons of ease of processing at moderately elevated temperatures, non-ionic ethoxylated alcohol surfactants with C10 to C15 alkyl residuals and about 4-12 ethoxy groups are preferred as the non-adhesion promoter nonionic surfactants. Nonionic surfactants with branched chain C10 to C14 alkyl residuals and 5-12 ethoxy groups are highly preferred. Inclusion of the preferred nonionic surfactant materials greatly facilitates rapid processing at lower batch temperatures.

In another embodiment, the composition comprises at least one surfactant distinct from the adhesion promoter and selected from the group consisting of anionic, cationic, zwitterionic, and amphoteric surfactants in an amount of greater than about 1 wt. %, preferably in an amount of from about 2 wt. % to about 10 wt. %.

In one embodiment, the composition comprises a non-polar hydrocarbon such as mineral oil in an amount of less than about 5 wt. %. In another embodiment, the composition comprises mineral oil in an amount of from greater than zero wt. % to about 5 wt. %. In another embodiment, the composition comprises mineral oil in an amount of from about 0.1 wt. % to about 2 wt. %.

In some embodiments, the compositions may be brought to 100 wt. % using any suitable material for the intended application. One of skill in the art will appreciate that this may include, but not be limited to, a balance of water, surface modifiers, germicides, preservatives, bleaches, cleaners, foamers, non-color-changing colorants, and combinations thereof.

Optionally, the compositions of the present invention may further comprise at least one solvent in an amount of from 0 wt. % to about 15 wt. % and the composition may further comprise at least one fragrance in an amount of from 0 wt. % to about 15 wt. %. Additionally, the composition may optionally include a hydrophilic polymer in an amount from 0 wt. % to about 5 wt. % to amplify transport effects of the composition. In one embodiment, "solvent" does not include water.

A further optional component is a superwetter. Without wishing to be limited by theory, it is thought that a superwetter may enhance the wet film provided in use of the composition.

Exemplary components suitable for use as an adhesion promoter may have long or long-chained molecules, for the most part linear, that are at least in part hydrophilic and thus include at least a hydrophilic residual or a hydrophilic group so as to provide interaction with water molecules. Preferably, the adhesion promoter has unbranched molecules to form a desired network-like structure to form adhesion-promoting molecules. The adhesion promoter may be totally hydrophilic or partly hydrophilic, partly hydrophobic.

Exemplary pure adhesion hydrophilic promoters suitable for use in the present invention include, for example: polyethylene glycol, cellulose, especially sodium carboxymethyl cellulose, hydroxyethyl cellulose, hydroxypropyl cellulose, or polysaccharides such as xanthan gum, agar, gellan gum, acacia gum, carob bean flour, guar gum or starch. Polysaccharides can form networks with the necessary solidity and a sufficient stickiness in concentrations of from 0 wt. % to about 10 wt. %; from 0 wt. % to about 5 wt. %; and from about 1 wt. % to about 2 wt. %.

The adhesion-promoting molecules can be synthetic or natural polymers, for instance, polyacrylates, polysaccharides, polyvinyl alcohols, or polyvinyl pyrrolidones. It is also possible to use alginates, diurethanes, gelatines, pectines, oleyl amines, alkyl dimethyl amine oxides, or alkyl ether sulfates.

Organic molecules with a hydrophilic and hydrophobic end may also be used as adhesion promoters. As hydrophilic residuals, for example, polyalkoxy groups, preferably polyethoxy, polypropoxy, or polybutyoxy or mixed polyalkoxy groups such as, for example, poly(ethoxypropoxy) groups can be used. Especially preferred for use as a hydrophilic end, for example, is a polyethoxy residual including from 15 to 55 ethoxy groups, preferably from 20 to 40 and more preferably from 20 to 35 ethoxy groups.

In some embodiments, anionic groups, for example, sulfonates, carboxylates, or sulfates, can be used as hydrophilic ends of the adhesion promoter. In other embodiments, soaps, especially sodium or potassium stearate, are suitable as adhesion promoters.

In embodiments wherein the adhesion-promoting molecules also have a hydrophobic end, straight-chained alkyl residuals are preferred for the hydrophobic residual, whereby in particular even-numbered alkyl residuals are preferred because of the better biological degradability. Without wishing to be limited by theory, it is thought that to obtain the desired network formation of the adhesion-promoting molecules, the molecules should be unbranched. If alkyl residuals are chosen as hydrophobic residuals, alkyl residuals with at least 12 carbon atoms are preferred. More preferred are alkyl chain lengths of from 16 to 30 carbon atoms, most preferred is from 16 to 22 carbon atoms. Exemplary adhesion promoters are polyalkoxyalkanes, preferably a mixture of $C_{16}$ to $C_{22}$ alkyl ethoxylate with from 20 to 50 ethylene oxide groups (EO), preferably from about 20 to about 35 EO.

Molecules that generally act like thickeners in aqueous systems, for example, hydrophilic substances, can also be used as adhesion promoters.

Without wishing to be limited by theory, it is thought that the concentration of the adhesion promoter to be used depends on its hydrophilicity and its power to form a network. When using polysaccharides, for example, concentrations from about 1 wt. % to about 2 wt. % of the adhesion promoter can be sufficient, whereas in embodiments comprising polyalkoxyalkanes the concentrations may be from about 10 wt. % to about 40 wt. %; in another embodiment from about 15 wt. % to about 35 wt. %; and in another embodiment still from about 25 wt. % to about 30 wt. %.

Also without wishing to be limited by theory, it is thought that in order to produce the desired number of adhering sites with the adhesion-promoting molecules through the absorption of water, the composition may contain at least about 25% by weight water, and optionally additional solvent. In one embodiment, the composition comprises water from about 40 wt. % to about 65 wt. %. One of skill in the art will appreciate that the amount of water that is to be used is dependent on, among other things, the adhesion promoter used and the amount of adjuvants also in the formula.

Exemplary anionic surfactants suitable for use include alkali metal $C_6$-$C_{18}$ alkyl ether sulfates, e.g. sodium lauryl ether sulfate; $\alpha$-olefin sulfonates or methyl taurides. Other suitable anionic surfactants include alkali metal salts of alkyl, alkenyl and alkylaryl sulfates and sulfonates. Some such anionic surfactants have the general formula $RSO_4M$ or $RSO_3M$, where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g., ammonium, sodium, potassium or lithium).

Exemplary nonionic sulfactants distinct from the adhesion promoter suitable for use include iso-C11 and iso-C13 branched alkyl ethoxylated alcohols under the tradenames GENAPOL UD and GENAPOL X, respectively, by the Clariant Corporation, Mt. Holly, N.C., USA; alkylpolyglycosides such as those available under the tradename GLUCOPON from Henkel, Cincinnati, Ohio, USA; those available under the trade name LUTENSOL XP (iso-C10 alkyl ethoxylate), TO (iso-C13 alkyl ethoxylate), AO (linear & branched mixture of $C_{13}$/$C_{15}$ alkyl ethoxylate) from BASF, Ludwigshafen, Germany; and TERGITOL S $C_{11}$-$C_{15}$ secondary alkyl alcohol ethoxylates from Dow Chemical Company, Midland, Mich., USA. Other nonionic surfactants suitable for use are linear C10-C14 alcohol ethoxylates. Amine oxides are also suitable.

At least one solvent can be present in the composition to assist in blending of surfactants and other liquids. The solvent is present in an amount of from about 0 wt. % to about 15 wt. %, preferably from about 1 wt. % to about 12 wt. %, and more preferably in an amount from about 5 wt. % to about 10 wt. %. Examples of solvents suitable for use are aliphatic alcohols of up to 8 carbon atoms; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; and mono- or diesters of alkylene glycols or polyalkylene glycols having up to 6 carbon atoms per glycol group and up to 6 carbon atoms in each ester group. Specific examples of solvents include t-butanol, t-pentyl alcohol; 2,3-dimethyl-2-butanol, benzyl alcohol or 2-phenyl ethanol, ethylene glycol, propylene glycol, dipropylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, glycerin, ethanol, isopropanol, and dipropylene glycol monoacetate. A preferred solvent is glycerin for reasons of performance, cost, and ecological/toxicity profile.

It is thought that the inclusion of a non-polar hydrocarbon, such as mineral oil, may serve to achieve increased stability and self-adherence to a hard surface, especially a ceramic surface. The mineral oil is present in an amount of greater than 0% by weight to about 5% by weight, based on the total weight of the composition. In one embodiment, mineral oil is present in an amount of from about 0.1% wt. % to about 3.5 wt. %. In another embodiment, mineral oil is present in an amount of from about 0.3 wt. % to about 2 wt. %. The amount of mineral oil to be included will depend on the adhesion performance of the balance of the formula. Without wishing to be limited by theory, it is thought that as the amount of mineral oil is increased, the adhesion is also increased. Although it provides benefits when used in the composition, it is also thought that the inclusion of the mineral oil in higher amounts without decreasing the amount of surfactant and/or thickener and/or adhesion promoters will result in the composition being thickened to a degree which makes processing of the composition during manufacture undesirable because the firmness of the composition makes it difficult to process. In manufacture, while the processing can be carried out under increased temperatures, such also increases the cost of manufacture and creates other difficulties due to the increased temperature level.

Non-limiting examples of hydrophilic polymers useful herein include those based on acrylic acid and acrylates, such as, for example, described in U.S. Pat. Nos. 6,593,288, 6,767,410, 6,703,358 and 6,569,261. Suitable polymers are sold under the trade name of MIRAPOL SURF S by Rhodia. A preferred polymer is MIRAPOL SURF S-500.

A superwetter is optionally included in the composition to enhance the maintenance of the wet film provided. A superwetter may thereby assist in decreasing the time of spreading. Examples of superwetters suitable for inclusion in the composition hydroxylated dimethylsiloxanes such as Dow Corning Q2-5211 (Dow Corning, Midland, Mich.). The superwetter(s) may be present (in addition to any other surfactant in the composition) in an amount of 0 to about 5 wt. %; preferably from about 0.01 to about 2 wt. %, and most preferably from about 0.1 wt. % to about 1 wt. %.

Fragrances and aromatic substances can be included in the composition to enhance the surrounding atmosphere. In one embodiment, a gel composition comprises less than 6 wt. % fragrance. In another embodiment, the gel composition comprises from 0 wt. % to 6 wt. % fragrance. In another embodiment still, the gel composition comprises from 0 wt. % to about 5 wt. % fragrance. In yet another embodiment, the gel composition comprises from about 2 wt. % to about 5 wt. % fragrance.

It is thought that an additional property which is important to the inventive gel compositions is the ability to maintain its form despite being subject to relatively high temperatures, referred to herein as "gel temperature". Specifically, this metric measures the temperature at which the non-viscous heated composition abruptly transitions to a viscosity of greater than about 1 Pa s as the composition cools. Further, having a relatively high composition gel temperature may provide processing, manufacturing, transport, and packaging advantages to producers. In one embodiment the composition has a gel temperature of greater than 50° C. In another embodiment, the composition has a gel temperature of from about 50° C. to about 80° C. In another embodiment still, the composition has a gel temperature of from about 55° C. to about 70° C.

The composition of the invention are in the form of a self-adhering gel, or gel-like, compositions for treating hard surfaces, wherein the viscosity of said compositions, in the temperature range of 20-25° C., is at least about 100 Pa s. In another embodiment, the viscosity of said compositions, in the temperature range of 20-25° C., is from about 150 Pa s to about 1000 Pa s. In yet another embodiment, the viscosity of said compositions, in the temperature range of 20-25° C., is from about 200 Pa s to about 400 Pa s.

EXAMPLES

TABLE 1

Representative Inventive Color-Changing Gel Compositions (Weight %)
Gel compositions A and B are examples of the first embodiment of the invention. Gel compositions A and B were prepared and approximately 14 grams of each sample was applied to the surface of individual toilet bowls above the water line. The change in color between the applied gel and the flushed tap water was noted for repeated toilet flushings. Municipal tap water (Racine, WI USA) was employed.

| INGREDIENTS | A Wt. % | B Wt. % |
|---|---|---|
| Linear C16-C18 Alkyl Ethoxylated Alcohol, 25 EO* | 29.500 | 29.500 |
| Fragrance | 5.000 | 5.000 |
| Iso-C13 Alkyl Ethoxylated Alcohol, 10 EO** | 2.500 | 2.500 |
| Glycerine | 6.000 | 6.000 |
| Citric Acid | — | 1.000 |
| Gluconic Acid, 50% in Water | 2.000 | — |
| GLYCACIL 2000 Preservative Solution*** | 0.150 | 0.150 |
| White Mineral Oil, Highly Refined | 0.300 | 0.300 |
| Bromocresol Green Color-Changing Dye | 0.300 | — |
| Bromocresol Purple Color-Changing Dye | — | 0.300 |
| Water | To 100% | To 100% |
| Gel Color As Applied to Toilet Bowl Surface | Orange | Orange |
| Flushed Toilet Bowl Water Exposed to Gel | Blue | Purple |

*GENAPOL T-250, Clariant Corporation
**GENAPOL X-100, Clariant Corporation
***Lonza Inc., Allendale, NJ USA

TABLE 2

Representative Inventive Color-Changing Gel Compositions (Weight %)
Gel compositions C, D and E are examples of the second embodiment of the invention. Seven grams of each gel composition C, D, E were prepared and applied to the surface of individual toilet bowls above the water line. The gel color of the initially applied gel and the color of the same gel sample after approximately 90 repeated toilet flushings with tap water was noted. Municipal tap water (Racine, WI USA) was employed.

| INGREDIENTS | C | D Wt. % | E |
|---|---|---|---|
| Linear C16-C18 Alkyl Ethoxylated Alcohol, 25 EO* | 29.599 | 29.598 | 29.598 |

TABLE 2-continued

Representative Inventive Color-Changing Gel Compositions (Weight %) Gel compositions C, D and E are examples of the second embodiment of the invention. Seven grams of each gel composition C, D, E were prepared and applied to the surface of individual toilet bowls above the water line. The gel color of the initially applied gel and the color of the same gel sample after approximately 90 repeated toilet flushings with tap water was noted. Municipal tap water (Racine, WI USA) was employed.

| INGREDIENTS | C | D<br>Wt. % | E |
|---|---|---|---|
| Fragrance | 5.000 | 5.000 | 5.000 |
| Iso-C13 Alkyl Ethoxylated Alcohol, 10 EO** | 2.500 | 2.500 | 2.500 |
| Glycerine | 6.000 | 6.000 | 6.000 |
| GLYCACIL 2000 Preservative Solution*** | 0.150 | 0.150 | 0.150 |
| Gluconic Acid Solution**** | 0.0375 | 0.0125 | 0.0625 |
| Bromocresol Green Color-Changing Dye | 0.001 | — | — |
| Bromocresol Purple Color-Changing Dye | — | 0.002 | — |
| Bromophenol Blue Color-Changing Dye | — | — | 0.002 |
| Acid Blue # 9 Dye | 0.00008 | — | — |
| White Mineral Oil, Highly Refined | 0.300 | 0.300 | 0.300 |
| Water | To 100% | To 100% | To 100% |
| Gel Color Initially Applied to Toilet Bowl Surface | Pale Yellow-Green | Yellow | Pale Yellow-Green |
| Gel Color After Approximately 90 Toilet Flushes | Blue | Blue-Purple | Dark Blue-Green |

*GENAPOL T-250, Clariant Corporation
**GENAPOL X-100, Clariant Corporation
***Lonza Inc., Allendale, NJ USA

TABLE 3

Representative Inventive Color-Changing Gel Composition (Weight %) Gel composition F is an example of the third embodiment of the invention. Seven grams of gel composition F was prepared and applied to the surface of a toilet bowl above the water line. The color of the initially applied gel was noted. After approximately 60 flushes, the sample was slightly more than half dissolved/eroded and the remaining adhered gel was combined with the freshly flushed toilet water in the bowl using a scrub brush. The color of the combined bowl water and gel cleaner was noted. Municipal tap water (Racine, WI USA) was employed.

| INGREDIENTS | F<br>wt % |
|---|---|
| Linear C16-C18 Alkyl Ethoxylated Alcohol, 25 EO* | 30.07 |
| Fragrance | 5.000 |
| Iso-C13 Alkyl Ethoxylated Alcohol, 10 EO** | 2.500 |
| Glycerine | 6.000 |
| GLYCACIL 2000 Preservative Solution*** | 0.150 |
| Sodium Bisulfate | 0.050 |
| Bromocresol Purple Color-Changing Dye | 0.030 |
| White Mineral Oil, Highly Refined | 0.300 |
| Water | To 100% |
| Gel Color Initially Applied to Toilet Bowl Surface | Yellow-Orange |
| Gel Color Immediately Before Dissolution in Toilet Bowl Water Using Toilet Brush | Yellow-Orange |
| Toilet Bowl Water When Combined with Residual Gel | Purple |

*GENAPOL T-250, Clariant Corporation
**GENAPOL X-100, Clariant Corporation
***Lonza Inc., Allendale, NJ USA

TABLE 4

Viscosity And Gel Temperature Of Representative Compositions

| | A | B | C | D | E | F |
|---|---|---|---|---|---|---|
| Gel Temperature (° C.) | 63 | 59 | 59 | 59 | 59 | 57 |
| Viscosity * | 230 | 241 | 248 | 261 | 250 | 210 |

* Pa s at 25° C., Brookfield R/S Plus Rheometer, Cone/Plate Configuration, Shear Rate 10.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A hard surface cleaning composition comprising (1) a cleaning system comprising components which render said composition a gel having a viscosity of about 100 to about 1000 Pa s at 20-25° C. and which is self-adhesive to a hard surface in absence of an adhesive or container and under a plurality of separate water-based rinses, wherein the water-based rinses have a pH of about 6 to about 8; and (2) a color-change system; wherein said composition progressively dissolves over said plurality of separate water-based rinses of said composition to provide a dissolved cleaning portion; and wherein said color-change system has a pH of about 2 to about 5 or a pH of about 9 to about 11 and comprises (a) greater than 0 and less than about 5 wt. % of at least one pH control agent, and (b) about 0.01 to about 2 wt. % of at least one color-changing dye which provides a first color to said composition when undissolved including through said plurality of separate water-based rinses, and which provides a second color to said dissolved cleaning portion to provide said water-based rinses with said second color, said first color being different from said second color.

2. The composition of claim 1, wherein said pH is about 2 to about 5 and said at least one pH control agent is an acidic compound having an acid disassociation constant from about $10^{-2}$ to about $10^{-6}$.

3. The composition of claim 1, wherein said pH is about 2 to about 5 and said at least one color-changing dye is one of methyl yellow, bromophenol blue, methyl orange, bromocresol green, methyl red, and bromocresol purple.

4. The composition of claim 1, wherein said pH is about 2 to about 5 and said at least one pH control agent is one of a mineral acid, alkali metal bisulfate salt, carboxylic acid, organo-sulfonic acid, organo-phosphonic acid, and sulfamic acid.

5. The composition of claim 1, wherein said pH is about 2 to about 5 and said at least one pH control agent is a buffered combination of an acid and a conjugate base salt of said acid.

6. The composition of claim 1, wherein said pH is about 2 to about 5 and said at least one pH control agent is at least one carboxylic acid selected from formic acid, acetic acid, propanoic acid, benzoic acid, phthalic acid, malonic acid, succinic acid, oxalic acid, glycolic acid, lactic acid, gluconic acid, glucoheptanoic acid, malic acid, citric acid, homopolymer of acrylic acid, copolymer of acrylic acid, homopolymer of malic acid, copolymer of malic acid, aminocarboxylic acid chelant, and aminophosphonic acid chelant.

7. The composition of claim 1, wherein said pH is about 9 to about 11 and said at least one color-changing dye is one of alizarin yellow R, thymolphthalein, phenolphthalein, and thymol blue.

8. The composition of claim 1, wherein said pH is about 9 to about 11 and said at least one pH control agent is one of alkali metal and alkaline earth metal hydroxides, alkali metal and alkaline earth metal oxides, alkali metal salts of carbonates, alkali metal salts of bicarbonates, alkali metal salts of phosphates, borates, silicates, aluminates, ammonia, ethanolamines, isopropanolamines, neutralized salts of aminocarboxylic acid chelant, and neutralized salts of aminophosphonic acid chelant.

9. The composition of claim 1, wherein said cleaning system includes at least one adhesion promoter which causes a bond with water and provides the composition with dimensional stability under action of said plurality of water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of anionic, nonionic, cationic, zwitterionic, and amphoteric surfactants.

10. The composition of claim 1, wherein said cleaning system includes at least one adhesion promoter which causes a bond with water and provides the composition with dimensional stability under action of said plurality of water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of nonionic surfactants with branched chain C10 to C14 alkyl residuals and 5-12 ethoxy groups.

11. The composition of claim 10, wherein said at least one adhesion promoter is present in an amount of about 20 to about 80 wt. %, and said at least one surfactant which is distinct from said adhesion promoter is present in an amount of greater than about 1 wt. % to about 10 wt. %.

12. A hard surface cleaning composition comprising (1) a cleaning system comprising components which render said composition a gel having a viscosity of about 100 to about 1000 Pa s at 20-25° C. and which is self-adhesive to a hard surface in absence of an adhesive or container and under a plurality of separate water-based rinses, wherein the water-based rinses have a pH of about 6 to about 8; and (2) a color-change system; wherein said composition progressively dissolves over said plurality of separate water-based rinses of said composition to provide a dissolved cleaning portion; and wherein said color change system has a pH of about 2 to about 5 or a pH of about 9 to about 11 and comprises (a) greater than 0 and less than 1 wt. % of at least one pH control agent, and (b) about 0.0001 to about 0.1 wt. % of at least one color-changing dye which provides a first color to said composition for at least a pre-determined number of said plurality of separate water-based rinses, and thereafter provides said composition with a second color which is different from said first color.

13. The composition of claim 12, wherein said pH is about 9 to about 11 and said at least one color-changing dye is one of alizarin yellow R, thymolphthalein, phenolphthalein, and thymol blue.

14. The composition of claim 12, wherein said pH is about 9 to about 11 and said at least one pH control agent is one of alkali metal and alkaline earth metal hydroxides, alkali metal and alkaline earth metal oxides, alkali metal salts of carbonates, alkali metal salts of bicarbonates, alkali metal salts of phosphates, borates, silicates, aluminates, ammonia, ethanolamines, isopropanolamines, neutralized salts of aminocarboxylic acid chelant, and neutralized salts of aminophosphonic acid chelant.

15. The composition of claim 12, wherein said pH is about 2 to about 5 and said at least one pH control agent is an acidic compound having an acid disassociation constant from about $10^{-2}$ to about $10^{-6}$.

16. The composition of claim 12, wherein said pH is about 2 to about 5 and said at least one color-changing dye is one of methyl yellow, bromophenol blue, methyl orange, bromocresol green, methyl red, and bromocresol purple.

17. The composition of claim 12, wherein said pH is about 2 to about 5 and said at least one pH control agent is one of a mineral acid, alkali metal bisulfate salt, carboxylic acid, organo-sulfonic acid, organo-phosphonic acid, and sulfamic acid.

18. The composition of claim 12, wherein said pH is about 2 to about 5 and said at least one pH control agent is a buffered combination of an acid and a conjugate base salt of said acid.

19. The composition of claim 12, wherein said pH is about 2 to about 5 and said at least one pH control agent is at least one carboxylic acid selected from formic acid, acetic acid, propanoic acid, benzoic acid, phthalic acid, malonic acid, succinic acid, oxalic acid, glycolic acid, lactic acid, gluconic acid, glucoheptanoic acid, malic acid, citric acid, homopolymer of acrylic acid, copolymer of acrylic acid, homopolymer of malic acid, copolymer of malic acid, aminocarboxylic acid chelant, and aminophosphonic acid chelant.

20. The composition of claim 12, wherein said cleaning system includes at least one adhesion promoter which causes a bond with water and provides the composition with dimensional stability under action of said plurality of separate water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of anionic, nonionic, cationic, zwitterionic, and amphoteric surfactants.

21. The composition of claim 12, wherein said cleaning system includes at least one adhesion promoter which causes a bond with water and provides the composition with dimensional stability under action of said plurality of water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of nonionic surfactants with branched chain C10 to C14 alkyl residuals and 5-12 ethoxy groups.

22. The composition according to claim 21, wherein said at least one adhesion promoter is present in an amount of about 20 to about 80 wt. %, and said at least one surfactant, which is distinct from said adhesion promoter, is present in an amount of greater than about 1 wt. % to about 10 wt. %.

23. A hard surface cleaning composition comprising (1) a cleaning system comprising components which render said composition a gel having a viscosity of about 100 to about 1000 Pa s at 20-25° C. and which is self-adhesive to a hard surface in absence of an adhesive or container and under a plurality of separate water-based rinses, wherein the water-based rinses have a pH of about 6 to about 8; and (2) a color-change system; wherein said composition progressively dissolves over said plurality of separate water-based rinses of said composition to provide a dissolved cleaning portion; and wherein said color-change system has a pH of about 2 to about 5 or a pH of about 9 to about 11 and comprises (a) about 0.01 to about 1 wt. % of at least one pH control agent, and (b) about 0.001 to about 0.5 wt. % of at least one color-changing dye which provides said composition with a first color when undissolved and in said dissolved cleaning portion, including through said plurality of separate water-based rinses, and provides said composition with a second color when said composition in substantial entirety is physically mixed with one of said plurality of water-based rinses, said first color being different from said second color.

24. The composition of claim 23, wherein said pH is about 9 to about 11 and said at least one color-changing dye is one of alizarin yellow R, thymolphthalein, phenolphthalein, and thymol blue.

25. The composition of claim 23, wherein said pH is about 9 to about 11 and said at least one pH control agent is one of alkali metal and alkaline earth metal hydroxides, alkali metal and alkaline earth metal oxides, alkali metal salts of carbonates, alkali metal salts of bicarbonates, alkali metal salts of phosphates, borates, silicates, aluminates, ammonia, ethanolamines, isopropanolamines, neutralized salts of aminocarboxylic acid chelant, and neutralized salts of aminophosphonic acid chelant.

26. The composition of claim 23, wherein said pH is about 2 to about 5 and said at least one pH control agent is an acidic compound having an acid disassociation constant from about $10^{-2}$ to about $10^{-6}$.

27. The composition of claim 23, wherein said pH is about 2 to about 5 and said at least one color-changing dye is one of methyl yellow, bromophenol blue, methyl orange, bromocresol green, methyl red, and bromocresol purple.

28. The composition of claim 23, wherein said pH is about 2 to about 5 and said at least one pH control agent is one of a mineral acid, alkali metal bisulfate salt, carboxylic acid, organo-sulfonic acid, organo-phosphonic acid, and sulfamic acid.

29. The composition of claim 23, wherein said pH is about 2 to about 5 and said at least one pH control agent is a buffered combination of an acid and a conjugate base salt of said acid.

30. The composition of claim 23, wherein said pH is about 2 to about 5 and said at least one pH control agent is at least one carboxylic acid selected from formic acid, acetic acid, propanoic acid, benzoic acid, phthalic acid, malonic acid, succinic acid, oxalic acid, glycolic acid, lactic acid, gluconic acid, glucoheptanoic acid, malic acid, citric acid, homopolymer of acrylic acid, copolymer of acrylic acid, homopolymer of malic acid, copolymer of malic acid, aminocarboxylic acid chelant, and aminophosphonic acid chelant.

31. The composition of claim 23, wherein said cleaning system includes at least one adhesion promoter which causes a bond with water and provides the composition with dimensional stability under action of said plurality of separate water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of anionic, nonionic, cationic, zwitterionic, and amphoteric surfactants.

32. The composition of claim 23, wherein said cleaning system includes at least one adhesion promoter which causes a bond with water and provides the composition with dimensional stability under action of said plurality of water-based rinses, and at least one surfactant which is distinct from said adhesion promoter; wherein at least one of said at least one adhesion promoter is selected from the group consisting of nonionic surfactants, and wherein said at least one surfactant which is distinct from said adhesion promoter is selected from the group consisting of nonionic surfactants with branched chain C10 to C14 alkyl residuals and 5-12 ethoxy groups.

33. The composition according to claim 32, wherein said at least one adhesion promoter is present in an amount of about 20 to about 80 wt. %, and said at least one surfactant which is distinct from said adhesion promoter is present in an amount of greater than about 1 wt. % to about 10 wt. %.

* * * * *